US005207951A

United States Patent [19]

Sauer et al.

[11] Patent Number: 5,207,951

[45] Date of Patent: * May 4, 1993

[54] AMINE OXIDE SURFACTANT COMPOSITIONS

[75] Inventors: Joe D. Sauer; Kim R. Smith; James E. Borland; Terry Crutcher, all of Baton Rouge, La.

[73] Assignee: Ethyl Corporation, Richmond, Va.

[ * ] Notice: The portion of the term of this patent subsequent to Nov. 7, 2019 has been disclaimed.

[21] Appl. No.: 750,191

[22] Filed: Aug. 27, 1991

[51] Int. Cl.[5] ..... C11D 1/75; C11D 1/72; C11D 3/26; C11D 17/08

[52] U.S. Cl. ..... 252/547; 252/174.21; 252/DIG. 14

[58] Field of Search ..... 252/547, 174.21, DIG. 14

[56] References Cited

U.S. PATENT DOCUMENTS 4,276,205 6/1981 Ferry ..... 252/528
4,904,359 2/1990 Pancheri et al. ..... 252/548

FOREIGN PATENT DOCUMENTS 0164396 9/1984 Japan .

*Primary Examiner*—Asok Pal
*Assistant Examiner*—P. Achutamurthy
*Attorney, Agent, or Firm*—Patricia J. Hogan

[57] ABSTRACT

Surfactant compositions which provide acceptable foamability at a lower cost than amine oxides consist of (A) an amine oxide corresponding to the formula RR'R"NO in which R is a primary alkyl group containing 6–24 carbons and R' and R" are independently selected from methyl, ethyl, and 2-hydroxyethyl and (B) a normally liquid polyalkylene glycol.

19 Claims, No Drawings

AMINE OXIDE SURFACTANT COMPOSITIONS

FIELD OF THE INVENTION

The invention relates to surfactant compositions and more particularly to such compositions which permit the attainment of good foam volume economically.

BACKGROUND

It is known that various surfactants have been found to be useful in cleaning compositions, such as shower gels, shampoos, and light duty detergents (e.g., dish detergents)—compositions in which good foamability is a prerequisite for consumer approval. The surfactants which have been used to the greatest extent in such compositions are anionic surfactants, such as alkyl sulfates, alkyl ether sulfates, sulfonates, sulfosuccinates, and sarcosinates.

Although the use of anionic surfactants in these compositions permits the attainment of desirable characteristics, including good foamability, it would be beneficial to find gentler surfactants which could provide acceptable performance without being too costly. Nonionic surfactants, including ethoxylated fatty alcohols and alkyldimethylamine oxides, are known to be gentler to the body than anionic surfactants. However, these nonionic surfactants have previously offered only a choice between the lower cost/poor foamability of surfactants such as the ethoxylates and the higher cost/good foamability of the amine oxides.

SUMMARY OF INVENTION

It has now been found that the cost of using an amine oxide as a surfactant can be reduced without the expected sacrifice in foamability performance when the surfactant is a mixture of (A) an amine oxide corresponding to the formula RR'R"NO in which R is a primary alkyl group containing 6–24 carbons and R' and R" are independently selected from methyl, ethyl and 2-hydroxyethyl and (B) a normally liquid polyalkylene glycol.

DETAILED DESCRIPTION

Although an amine oxide used in the practice of the invention may be any compound corresponding to the above formula, it is preferably such an amine oxide in which the primary alkyl group has a straight chain in at least most of the molecules, generally at least 70%, most preferably at least 90% of the molecules. The amine oxides which are especially preferred are those in which R contains 8–18 carbons and R' and R" are both methyl.

Exemplary of the preferred amine oxides are the N-hexyl-, N-octyl-, N-decyl-, N-docosyl-, N-tetradecyl-, N-hexadecyl-, N-octadecyl-, N-eisocyl-, N-docosyl-, and N-tetracosyldimethylamine oxides, the corresponding amine oxides in which one or both of the methyl groups are replaced with ethyl or 2- hydroxyethyl groups, etc., and mixtures thereof. A particularly preferred amine oxide is N-tetradecyldimethylamine oxide.

Polyalkylene glycols which may be used in admixture with the amine oxides are those which are normally liquid, i.e., single polyalkylene glycols, such as polyethylene glycols and polypropylene glycols, and mixtures of such glycols having average molecular weights such as to be liquid at ambient temperature.

Since the polyalkylene glycols are typically much less expensive than the amine oxides, it is not surprising that any amount of an amine oxide/polyalkylene glycol surfactant composition of the invention costs less than the same amount of the amine oxide alone. What is surprising is that each of the mixtures, regardless of its particular polyalkylene glycol content, has a foamability performance greater than would be expected of an amine oxide/polyalkylene glycol mixture containing that amount of polyalkylene glycol.

It is generally preferred for the amine oxide/polyalylene glycol mixtures to obtain at least about 15% by weight of the amine oxide component in order for the foamability to be substantially better than that of the polyalkylene glycol component. An amine oxide content of at least about 40% by weight is even more preferred to achieve a foamability performance which is at least close to the foamability performance of the amine oxide component; and the most preferred mixtures are apt to be those having an amine oxide content of above 45–95% by weight.

The amine oxide/polyalkylene glycol mixtures containing 45–95% by weight of amine oxide not only cost less than the amine oxide alone on an equal amount basis but provide even more foam than the amine oxide component. Thus, they can be used in smaller amounts than the amine oxide to provide a given level of foam, making them even more cost effective.

The invention is advantageous in that it provides novel nonionic surfactant compositions which can provide acceptable levels of foam more economically than the individual components of the compositions. This characteristic of the mixtures makes them valuable for use in the cleaning compositions which require foaming for customer approval, e.g., shampoos, shower gels, and light duty detergents.

When employed in such compositions, the surfactant compositions are utilized in an aqueous medium, which typically constitutes about 10–90% of the weight of the compositions; and they may be used in conjunction with other ingredients of the types conventionally used in the compositions. Such ingredients include, e.g., viscosity improvers, pH adjusters, colorants, pearlizing agents, clarifying agents, fragrances, preservatives, antioxidants, chelating agents, skin and hair conditioners, botanical extracts, and antibacterial agents.

The following examples are given to illustrate the invention and are not intended as a limitation thereof. Unless otherwise specified, quantities mentioned in the examples are quantities by weight.

EXAMPLE I

Dissolve varying amounts of N-tetradecyldimethylamine oxide and PEG-300 (a liquid polyethylene glycol having an average molecular weight of 300) in hard water (200 ppm as $CaCO_3$) to provide solutions having a total surfactant content of 0.1%. Measure the foamability of the surfactants by (1) placing 30 mL of each of the solutions in a 100 mL stoppered graduated cylinder, (2) inverting the cylinder ten times, (3) measuring the foam height, (4) repeating steps 1–3 twice, and (5) calculating the average of the three measurements. The proportions of amine oxide and PEG-300 used in preparing each of the solutions and the foam heights obtained from them are shown in Table I.

TABLE I

| Amine Oxide (%) | PEG-300 (%) | Foam Height (mL) |
|---|---|---|
| 100 | 0 | 33 |
| 75 | 25 | 36 |
| 50 | 50 | 36 |

TABLE I-continued

| Amine Oxide (%) | PEG-300 (%) | Foam Height (mL) |
|---|---|---|
| 25 | 75 | 27 |
| 0 | 100 | 10 |

EXAMPLE II

Use the procedure of Example I to determine the surfactant efficiency of 50/50 mixtures of N-tetradecyldimethylamine oxide and liquid polyethylene glycols having average molecular weights of 400 and 600, respectively. Both the amine oxide/PEG-400 mixture and the amine oxide/PEG-600 mixture provide an average of 37 mL of foam.

EXAMPLE III

Following the same procedure as in the preceding examples, prepare and test an aqueous solution of a 50/50 mixture of N-tetradecyldimethylamine oxide and a liquid polypropylene glycol having an average molecular weight of 400. The mixture provides an average of 45 mL of foam.

What is claimed is:

1. A surfactant composition consisting of (A) an amine oxide corresponding to the formula RR'R''NO in which R is a primary alkyl group containing 6–24 carbons and R' and R' are independently selected from methyl, ethyl, and 2-hydroxyethyl and (B) a normally liquid polyalkylene glycol.

2. The surfactant composition of claim 1 having an amine oxide content of at least about 15% by weight.

3. The surfactant composition of claim 2 having an amine oxide content of at least about 40% weight.

4. The surfactant composition of claim 3 having an amine oxide content of about 45–95% by weight.

5. The surfactant composition of claim 1 wherein R is a primary alkyl group containing 10–18 carbons and R' and R'' are

6. The surfactant composition of claim 1 wherein the normally liquid polyalkylene glycol is a polyethylene glycol.

7. The surfactant composition of claim 6 containing at least 15% by weight of an N-alkyldimethylamine oxide in which the N-alkyl is a primary alkyl group which contains 10–18 carbons.

8. The surfactant composition of claim 7 having an amine oxide content of at least about 40% by weight.

9. The surfactant composition of claim 8 having an amine oxide content of about 45–95% by weight.

10. The surfactant composition of claim 6 containing at least 15% by weight of N-tetradecyldimethylamine oxide.

11. The surfactant composition of claim 10 having an amine oxide content of at least about 40%.

12. The surfactant composition of claim 11 having an amine oxide content of about 45–95%.

13. The surfactant composition of claim 1 wherein the normally liquid polyalkylene glycol is a polypropylene glycol.

14. The surfactant composition of claim 13 containing at least 15% by weight of an N-alkyldimethylamine oxide in which the N-alkyl is a primary alkyl group which contains 10–18 carbons.

15. The surfactant composition of claim 14 having an amine oxide content of at least about 40% by weight.

16. The surfactant composition of claim 15 having an amine oxide content of about 45–95% by weight.

17. The surfactant composition of claim 13 containing at least 15% by weight of N-tetradecyldimethylamine oxide.

18. The surfactant composition of claim 17 having an amine oxide content of at least about 40% by weight.

19. The surfactant composition of claim 18 having an amine oxide content of about 45–95% by weight.

* * * * *